United States Patent [19]

Wisneski, Jr. et al.

[11] Patent Number: 4,965,494

[45] Date of Patent: Oct. 23, 1990

[54] CAPACITOR CHARGING CIRCUIT FOR TIMING LIGHT POWER SOURCE

[75] Inventors: Leonard J. Wisneski, Jr., Kenosha; Gordon Lindhard, Racine, both of Wis.

[73] Assignee: Snap-on Tools Corporation, Kenosha, Wis.

[21] Appl. No.: 789,474

[22] Filed: Oct. 21, 1985

[51] Int. Cl.[5] ..... H05B 41/34

[52] U.S. Cl. ..... 315/241 S; 315/209 CD

[58] Field of Search ..... 315/241 R, 241 S, 241 P; 307/584; 331/173, 149, 153

[56] References Cited

U.S. PATENT DOCUMENTS

| | | | |
|---|---|---|---|
| 3,155,921 | 11/1964 | Fischman | 331/117 |
| 3,368,143 | 2/1968 | Roberts et al. . | |
| 3,727,124 | 4/1973 | Kahen . | |
| 3,789,266 | 1/1974 | Polman et al. | 315/194 |
| 3,813,931 | 6/1974 | Rennick et al. . | |
| 4,005,337 | 1/1977 | Rabe | 315/241 S |
| 4,092,585 | 5/1978 | Bovenlander . | |
| 4,095,170 | 6/1978 | Schmitt . | |
| 4,146,833 | 3/1979 | McKinnon et al. . | |
| 4,156,166 | 5/1979 | Shapiro et al. . | |
| 4,412,156 | 10/1983 | Ota | 315/308 |
| 4,422,016 | 12/1983 | Kurple . | |
| 4,459,498 | 7/1984 | Stengl et al. | 307/584 |

*Primary Examiner*—Eugene R. LaRoche

*Attorney, Agent, or Firm*—Emrich & Dithmar

[57] ABSTRACT

A strobe light power source includes a capacitor which is alternately charged through an inverter transformer and a rectifier and discharged through a strobe lamp. A MOSFET switch is connected in series with the transformer primary and has applied to its gate electrode a rectangular wave output signal from an oscillator. The oscillator and the transformer primary are coupled to a power supply independently of each other. A breakdown diode is connected in parallel with the MOSFET to limit the voltage thereacross.

15 Claims, 1 Drawing Sheet

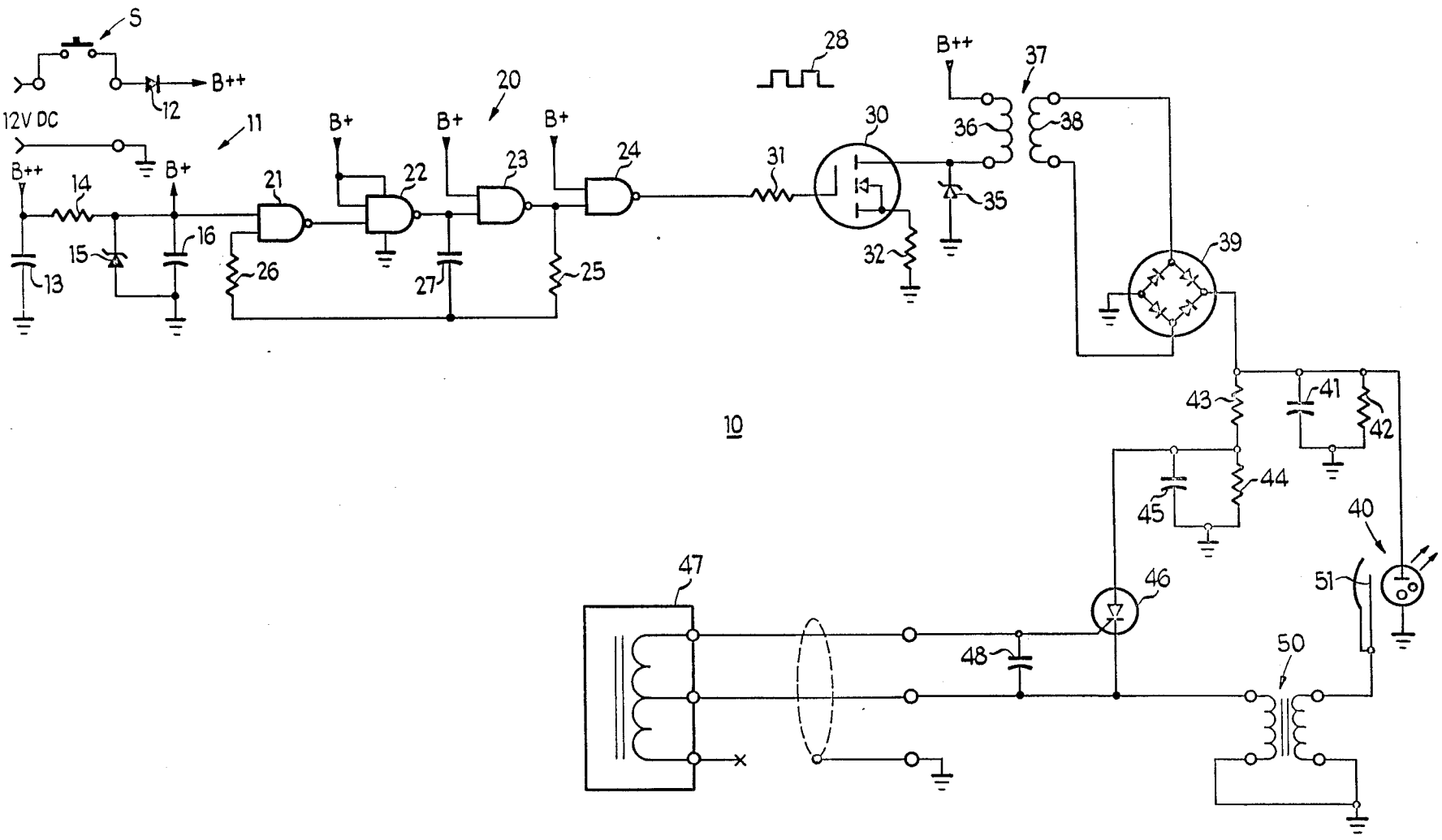
10
11
12V DC
B++
B+
S
12
13
14
15
16
20
21
22
23
24
25
26
27
28
30
31
32
35
36
37
38
39
40
41
42
43
44
45
46
47
48
50
51

CAPACITOR CHARGING CIRCUIT FOR TIMING LIGHT POWER SOURCE

BACKGROUND OF THE INVENTION

The present invention relates to strobe lights, such as ignition timing lights, of the type which are powered by a capacitive discharge, and relates particularly to a capacitor charging circuit.

Strobe lights typically comprise a glass lamp in which a gas is sealed. The lamp typically includes two power electrodes and may include a trigger electrode. Energy for activating the lamp or ionizing the gas stored within the lamp is generally stored in one or more capacitors connected in parallel with the lamp. Once a sufficient amount of energy has been stored in the capacitors and it is desired to flash the lamp, a firing pulse is applied to the trigger electrode. The firing pulse ionizes the gas sufficiently to allow current to flow between the two power electrodes, which results in a brilliant flash of the strobe light.

In one known type of strobe light circuit the capacitor is charged by current pulses applied through a transformer and a rectifier. In one such device, disclosed in U.S. Pat. No. 4,095,170, the primary winding of the transformer forms part of the oscillator, which is connected in a push-pull configuration. This arrangement is characterized by relatively high power consumption. In another device, disclosed in U.S. Pat. No. 4,422,016, an electronic switch is connected in the transformer primary circuit, the switch being controlled by a pulse width modulated signal which is derived from the transformer primary current. But the electronic switch is a bipolar transistor which is subject to thermal runaway, with resultant transformer blowout.

SUMMARY OF THE INVENTION

It is a general object of the present invention to provide an improved strobe light and capacitor charging circuit therefor of the type which utilizes an oscillatory signal applied through a transformer.

An important object of the invention is the provision of a capacitor charging circuit of the type set forth, which consumes relatively little power.

It is another object of the invention to provide a capacitor charging circuit of the type set forth, which is not subject to damage from overheating.

Another object of the invention is the provision of a capacitor charging circuit of the type set forth, wherein the transformer primary winding does not form a part of the oscillator, and wherein the oscillatory signal is not derived from the transformer primary current.

Still another object of the invention is the provision of a capacitor charging circuit of the type which utilizes a switch in the transformer primary circuit wherein the voltage across the switch is limited.

These and other objects of the invention are attained by providing in a strobe light having capacitance means successively charged by a power supply through a charging circuit and discharged through a strobe lamp, the improvement comprising: electronic switch means coupled to the charging circuit for controlling the input current thereto, oscillator means coupled to the power supply independently of the charging circuit and generating a rectangular wave output signal of a predetermined frequency, and means for coupling the rectangular wave output signal to the electronic switch means for controlling the operation thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawing a preferred embodiment thereof, from an inspection of which, when considered in connection with the following description, the invention, its construction and operation, and many of its advantages should be readily understood and appreciated.

The sole drawing FIGURE is a schematic circuit diagram of the strobe light circuit, incorporating a capacitor charging circuit in accordance with the present invention.

DESCRIPTION OF THE PREFERRED EMBODIMENT

There is illustrated in the drawing a timing light, generally designated by the numeral 10, which includes a high-intensity lamp 40, which may be a xenon flash tube. The timing light 10 has a power supply 11, adapted to be coupled to an associated 12 VDC power source, such as an automobile battery. The power supply 11 produces a B++ voltage of 12 VDC through an ON-OFF switch S and a reverse polarity protection diode 12. The B++ voltage is connected through a capacitor 13 to ground and through a resistor 14 to the cathode of a Zener diode 15, the anode of which is grounded. A low pass filter capacitor 16 is connected in parallel with the Zener diode 15. There is produced at the cathode of the Zener diode 15 a regulated B+ supply voltage, the circuit values preferably being such that the B+ voltage is 10 VDC.

The B+ supply voltage is applied to an oscillator 20 of known construction, including NAND gates 21, 22, 23 and 24, with the B+ supply voltage being applied to one input of each of the NAND gates. The other input of each of the NAND gates 22, 23 and 24 is connected to the output of the preceding NAND gate. The output of NAND gate 23 is also connected through resistors 25 and 26 to the second input of the NAND gate 21. The output of the NAND gate 22 is connected through a capacitor 27 to the junction between the resistors 25 and 26. The oscillator 20 operates in a known manner to produce a rectangular wave output signal 28, the circuit values preferably being such that the rectangular wave 28 is substantially square, i.e., having a duty cycle of substantially 50%, with a frequency of substantially 20 KHz.

The output of the oscillator 20 is connected through a resistor 31 to the gate electrode of an electronic switch, preferably a metal oxide semiconductor field effect transistor (MOSFET) 30. The source electrode of the MOSFET 30 is grounded through a resistor 32, and a breakdown diode 35 is connected between the drain electrode of the MOSFET 30 and ground. Preferably, the diode 35 is a unidirectional transient voltage suppressor of the type sold by Motorola, Inc. under the trademark MOSORB. This type of diode has a breakdown region which spans a predetermined voltage range. The diode begins to conduct a reverse current at the lower end of the breakdown range and the current gradually increases to the upper end of the breakdown range.

The MOSFET 30 is connected in series with the primary winding 36 of a transformer 37 and the resistor 32 between the B++ supply and ground. The secondary winding 38 of the transformer 37 is connected across the input of a full wave rectifying diode bridge 39, the output of which is connected to the anode of the lamp 40, the cathode of which is grounded.

Connected in parallel with the lamp 40 and with each other are a capacitor 41 and a resistor 42. The output of the diode bridge 39 is also connected through series resistors 43 and 44 to ground, a capacitor 45 being connected in parallel with the resistor 44. The junction between the resistors 43 and 44 is connected to the anode of an SCR 46, the gate and cathode of which are connected across an inductive pickup coil 47 which may, for example, be coupled to the spark plug of an internal combustion engine for sensing each spark event. A noise-suppression capacitor 48 is connected across the gate-cathode junction of the SCR 46. The cathode of the SCR 46 is connected to the primary winding of a pulse transformer 50, the secondary winding of which is connected to a trigger electrode 51 of the lamp 40.

In operation, the rectangular wave signal 28 at the output of the oscillator 20 energizes the MOSFET 30, producing current pulses in the transformer 37, thereby producing on the secondary winding 38 high voltage pulses which are rectified in the diode bridge 39. The rectified voltage pulses from the diode bridge 39 charge the capacitors 41 and 45, the former being charged rapidly because there is very little charging resistance, and the latter being charged more slowly through the resistor 43. The resistor 32 provides negative feedback for greater stability of the MOSFET 30 to afford more consistency in light output for different MOSFETS.

When an ignition pulse is sensed by the pickup coil 47, it is applied to the gate of the SCR 46, causing it to fire, thereby discharging the capacitor 45. The circuit values are such that the discharge of the capacitor 45 through the SCR 46 places about 300 volts across the primary winding of the transformer 50, which is transformed to about 10 KV on the secondary. This high triggering voltage is applied to the trigger electrode 51 which ionizes the gas in the lamp 40 to cause it to fire, the voltage on the anode thereof being supplied by the capacitor 41, which discharges through the lamp 40. The resistor 43 serves to isolate the capacitor 41 so that it can discharge only through the lamp 40 and not through the SCR 46. The resistors 42 and 44 serve, respectively, to discharge the capacitors 41 and 45 when the timing light 10 is turned off.

The lamp 40 can flash only when the capacitor 41 is charged. If the capacitor 41 is not fully charged, then there will be insufficient voltage on the anode of the lamp 40 to fire it. Preferably, the time constant is selected so that if the engine speed is greater than 7500 rpm, the pulses on the inductive pickup coil 47 come too rapidly and the lamp 40 flashes only once every other pulse.

Prior devices have had a tendency to fail because of the heat generated through the bipolar transistors connected to the primary winding 36 of the transformer 37. A timing light tends to be used in conditions of high ambient temperature, such as next to a hot engine and/or in the presence of sunlight. In a bipolar transistor, the current increases with increasing temperature, which can give rise to thermal runaway. For the same reasons, the transformer 37 in prior devices would tend to blow out. In the present invention, on the other hand, the current through the MOSFET 30 drops when it is heated, thereby minimizing the chance of thermal failure.

The 20 KHz rectangular wave signal 28 from the oscillator 20 has a substantially 25 microsecond ON time and a 25 microsecond OFF time. The drain voltage of the MOSFET 30 during the ON time is its saturation voltage, preferably about 1.5 volts. On the negative transition of the rectangular wave signal 28, ringing of the transformer 37 takes place extending up to the maximum breakdown voltage of the diode 35. Within 10–15 microseconds the ringing ceases and the drain voltage increases to its maximum, preferably about 12 volts. On the next positive transition of the rectangular wave signal 28 the drain voltage again reverts to 1.5 volts, except that some noise voltage on the drain electrode occurs at the end of negative transition. The combination of the oscillator 20 with the series connection of the transformer primary winding 36 and the MOSFET 30 results in a charging circuit which has relatively low power consumption as compared with prior charging circuits.

The MOSFET 30 preferably has a drain to source rating of about 100 volts. The ringing of the transformer 37 may well exceed that level. Thus, the diode 35 is provided to limit the voltage across the MOSFET 30. Preferably, the diode 35 has a 68 volt rating, although its peak inverse voltage at peak inverse current is 92 volts. Thus, the voltage across the diode 35, and across the MOSFET 30, is limited to 92 volts, irrespective of the amount of current through the diode 35, thereby preventing the drain to source voltage of the MOSFET 30 from ever reaching its voltage rating of 100 volts. The diode 35 starts to draw current away from the MOSFET 30 when the ringing of the transformer 37 reaches 68 volts. As the voltage increases the current through the diode 35 increases until, when the voltage is 92 volts, substantially all current is directed through the diode 35.

From the foregoing, it can be seen that there has been provided an improved timing light and capacitor charging circuit therefor, which is characterized by low power consumption and resistance to thermal runaway.

We claim:

1. In a strobe light having capacitance means successively charged by a power supply through a charging circuit and discharged through a strobe lamp, the improvement comprising: active electronic switch means including a metal oxide semiconductor field effect transistor coupled to the charging circuit for controlling the input current thereto during charging of the capacitance means, oscillator means coupled to the power supply independently of the charging circuit and generating a rectangular wave output signal of a predetermined frequency, and means for coupling said rectangular wave output signal to said electronic switch means for controlling the operation thereof.

2. The strobe light of claim 1, wherein said predetermined frequency is 20 KHz.

3. The strobe light of claim 1, wherein said rectangular wave output signal has a duty cycle of essentially 50%.

4. The strobe light of claim 1, wherein said means for coupling includes a resistor.

5. The strobe light of claim 1, and further comprising voltage control means connected in parallel with said electronic switch switch means for limiting the voltage thereacross.

6. The strobe light of claim 1, wherein the power supply includes low pass filter means.

7. In a strobe light having capacitance means successively charged by a power supply through a charging circuit and discharged through a strobe lamp, the improvement comprising: active electronic switch means including a metal oxide semiconductor field effect transistor coupled to the charging circuit for controlling the input current thereto during charging of the capacitance means, oscillator means coupled to said electronic switch means for controlling the operation thereof, and voltage control means connected in parallel with said electronic switch means for limiting the voltage thereacross.

8. The strobe light of claim 7, wherein said oscillator means is coupled to the power supply independently of the charging circuit.

9. The strobe light of claim 7, wherein said voltage control means includes a breakdown diode.

10. A charging circuit for a strobe light having capacitance means successively charged by a power supply and discharged through a strobe lamp, said charging circuit comprising: transformer means having a primary winding coupled to the power supply and a secondary winding coupled to the strobe lamp, active electronic switch means including a metal oxide semiconductor field effect transistor connected in series with said primary winding for controlling the current therethrough during charging of the capacitance means, oscillator means coupled to the power supply independently of said transformer means and generating a rectangular wave output signal of a predetermined frequency, means for coupling said rectangular wave output signal to said electronic switch means for controlling the operation thereof, and voltage control means connected in parallel with said electronic switch means for limiting the voltage thereacross.

11. The charging circuit of claim 10, wherein said means for coupling includes a resistor.

12. The charging circuit of claim 10, wherein said predetermined frequency is 20 KHz.

13. The charging circuit of claim 10, wherein the power supply includes low pass filter means.

14. The charging circuit of claim 10, wherein said voltage control means includes a breakdown diode.

15. The charging circuit of claim 10, wherein said rectangular wave output signal has a duty cycle of essentially 50%.

* * * * *